US006092292A

United States Patent [19]

Molnar et al.

[11] Patent Number: 6,092,292

[45] Date of Patent: Jul. 25, 2000

[54] CAN OPENER

[75] Inventors: Joseph F. Molnar, Cromwell, Conn.; Walter G. Birdsell, Marlborough, Mass.; Paul Holbrook, Buffalo Grove, Ill.; Michael E. Laude, Upton, Mass.

[73] Assignee: HP Intellectual Corp., Wilmington, Del.

[21] Appl. No.: 09/058,247

[22] Filed: Apr. 10, 1998

[51] Int. Cl.[7] ..... B67B 7/46

[52] U.S. Cl. ..... 30/410; 30/421

[58] Field of Search ..... 30/410, 419, 421, 30/423, 424, 425

[56] References Cited

U.S. PATENT DOCUMENTS

| | | | |
|---|---|---|---|
| D. 296,753 | 7/1988 | Tsuji et al. | D8/36 |
| 2,974,409 | 3/1961 | Ghinazzi | 30/421 |
| 2,979,815 | 4/1961 | Rohde et al. | 30/421 |
| 3,002,274 | 10/1961 | Jepson et al. | 30/410 |
| 3,105,297 | 10/1963 | Clowers | 30/410 |
| 3,156,044 | 10/1962 | Congdon et al. | 30/404 |
| 3,675,321 | 7/1972 | Arel et al. | 30/404 |
| 3,765,085 | 10/1973 | Ponczek et al. | 30/421 |
| 4,534,108 | 8/1985 | Yamamoto et al. | 30/419 |
| 4,561,182 | 12/1985 | Yamamoto et al. | 30/410 |
| 4,831,735 | 5/1989 | Bast et al. | 30/410 |

*Primary Examiner*—Hwei-Siu Payer
*Attorney, Agent, or Firm*—Barry E. Deutsch

[57] ABSTRACT

A can opener (30) includes a housing (32) which supports a drive wheel (64) for rotating a can (82) loaded on the opener. While the can (82) is being rotated by the drive wheel (64), a cutter (74) is severing a lid (80) of the can therefrom. An actuator (86) is pivotally mounted at the rear of the housing (32) and extends across the top, and over the front, of the can opener (30) to provide the external control for operating the can opener. A switching mechanism (136) and a disc (184) are located within the housing (32) and are responsive to movement of the actuator (86) by a user to operate the can opener (30). A magnet assembly (98) is removably located on the underside of the actuator (86) for attaching magnetically to the lid (80) of the can (82) during a lid-cutting operation to facilitate removal of the lid from the can after completion of the lid-cutting operation. A blade sharpener (42) is located at the rear of the housing (32).

13 Claims, 14 Drawing Sheets

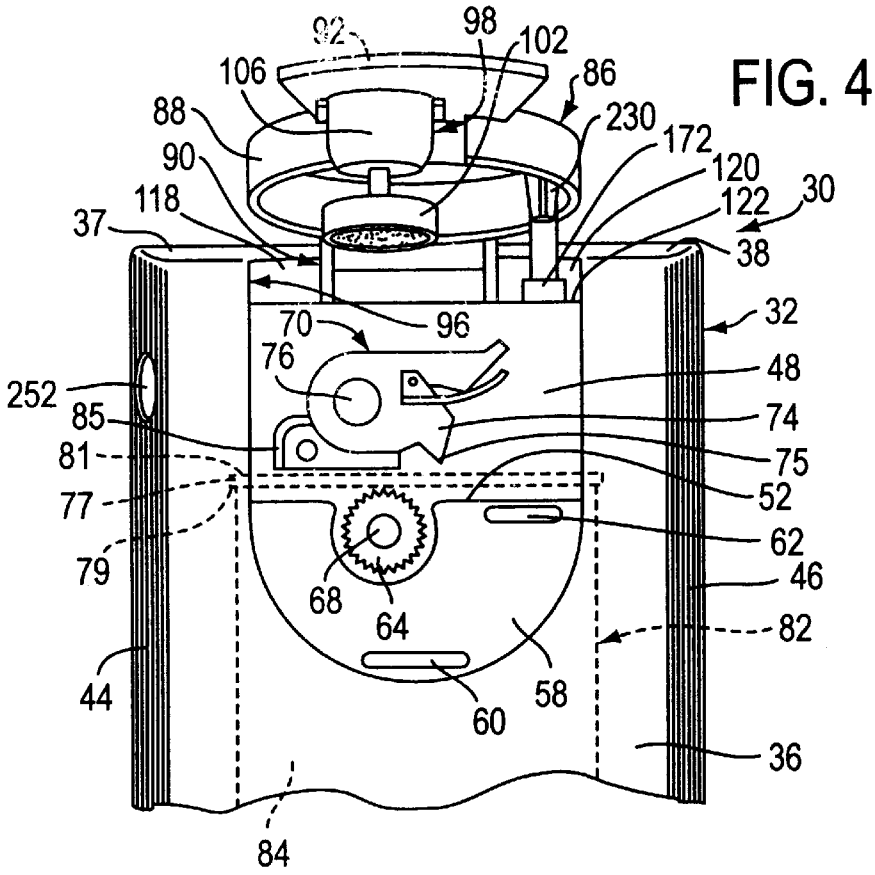
FIG. 4
FIG. 5
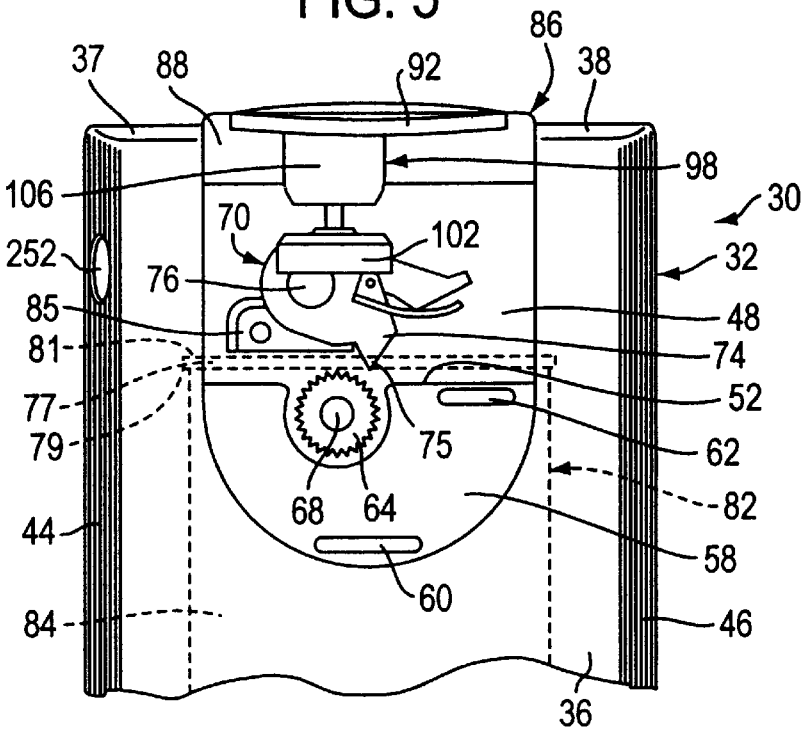

CAN OPENER

BACKGROUND OF THE INVENTION

This invention relates to a can opener, and particularly relates to a motor-driven can opener for facilitating the separation and removal of a lid from a can body.

A typical electrically-operated motor-driven can opener basically includes a drive wheel, a can retainer, a cutter and a lid-lifting permanent magnet, all located on one side of a housing, and a motor within the housing. When using a can opener of this type, a user inserts an underside of an edge lip, which surrounds a lid of a can, into driving engagement with the drive wheel while an inner side surface of the lip adjacent the lid is moved into engagement with the can retainer. In this assembly, the can is retained with the housing in preparation for, and during, the can opening operation.

The user then moves, and holds, an actuator which facilitates movement of the cutter into piercing engagement with the lid adjacent the edge lip, placement of the magnet in engagement with the lid and the application of electrical energy to the motor to initiate the lid-cutting operation. When electrical energy is applied to the motor, the drive wheel is rotated and imparts motion to the can whereby the cutter cuts the lid, adjacent the edge lip, as the can is moved. Eventually, the lid is fully severed from the can and the magnet holds the separated lid independently of the remainder of the can. At this time, the user releases the actuator and the electrical energy is removed from application to the motor whereby the drive wheel ceases turning. The lid is separated from the magnet and the opened can is removed from the can opener by a maneuver which is the reverse of the assembly procedure noted above.

When using can openers of the type described above, the magnet and/or the actuator frequently are located in such a manner that it is difficult for the user to have a clear view for can loading and unloading procedures. Also, the actuator is frequently mounted to the housing for pivotal or sliding movement in a plane which is parallel to, and fully in, the front of the housing, thereby further obstructing the users view. Thus, there is a need for a can opener which provides substantially an unobstructed view for a user of the can opener, particularly during can loading and unloading procedures.

Typically, in can openers of the type described above, the actuator is used to depress a plunger to initiate the application of electrical energy to the motor, and to operate a mechanism within the housing to urge the cutter into piercing engagement with the lid of the loaded can. Frequently, the plunger and the mechanism combine to form a complex structure within the housing which requires significant force upon the actuator to facilitate operation of the can opener and to retain the actuator in place during such operation of the can opener. Thus, there is a need for a can opener having an actuator which is mounted in such a manner, and which includes a structural arrangement, that the actuator is manipulable with relative ease.

SUMMARY OF THE INVENTION

Therefore, it is an object of this invention to provide a can opener which facilitates a clear view for the user when loading and unloading cans onto the opener.

Another object of this invention is to provide a can opener having structural features which allows use of thereof with relative ease.

With these and other objects in mind, this invention contemplates a can opener which includes a housing having an exterior working area on a front wall thereof, on which a drive wheel and a cutter are mounted for cutting a lid of a can. The housing is formed with a top wall which extends from a juncture thereof with the front wall to a rear juncture with a rear wall of the housing. An actuator, the manipulation of which facilitates piercing of the lid by the cutter, is attached to the housing generally at the rear juncture for selective movement relative to the housing and away from the front wall of the housing thereby to reveal fully the driving wheel and the cutter for easy access during loading and unloading of cans with respect to the working area.

This invention further contemplates a can opener which includes a housing and a can-lid cutter mounted on a face of the housing for cutting the lid of a can. An actuator is mounted for movement relative to the housing for facilitating operation of the can-lid cutter. A nest of a prescribed structure is formed in an undersurface of the actuator, and a magnetic lid-attaching assembly is removably mounted within the nest of the actuator.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings:

FIG. 4 is a partial front view of the can opener of FIG. 1 showing the actuator and the cutter in a can loading, or fully raised, position in accordance with certain principles of the invention;

FIG. 5 is a partial front view of the can opener of FIG. 1 showing the actuator and the cutter in a cutter pre-load, or partially lowered, position in accordance with certain principles of the invention;

DETAILED DESCRIPTION OF THE PREFERRED EMBODIMENT OF THE INVENTION

Figure 1:
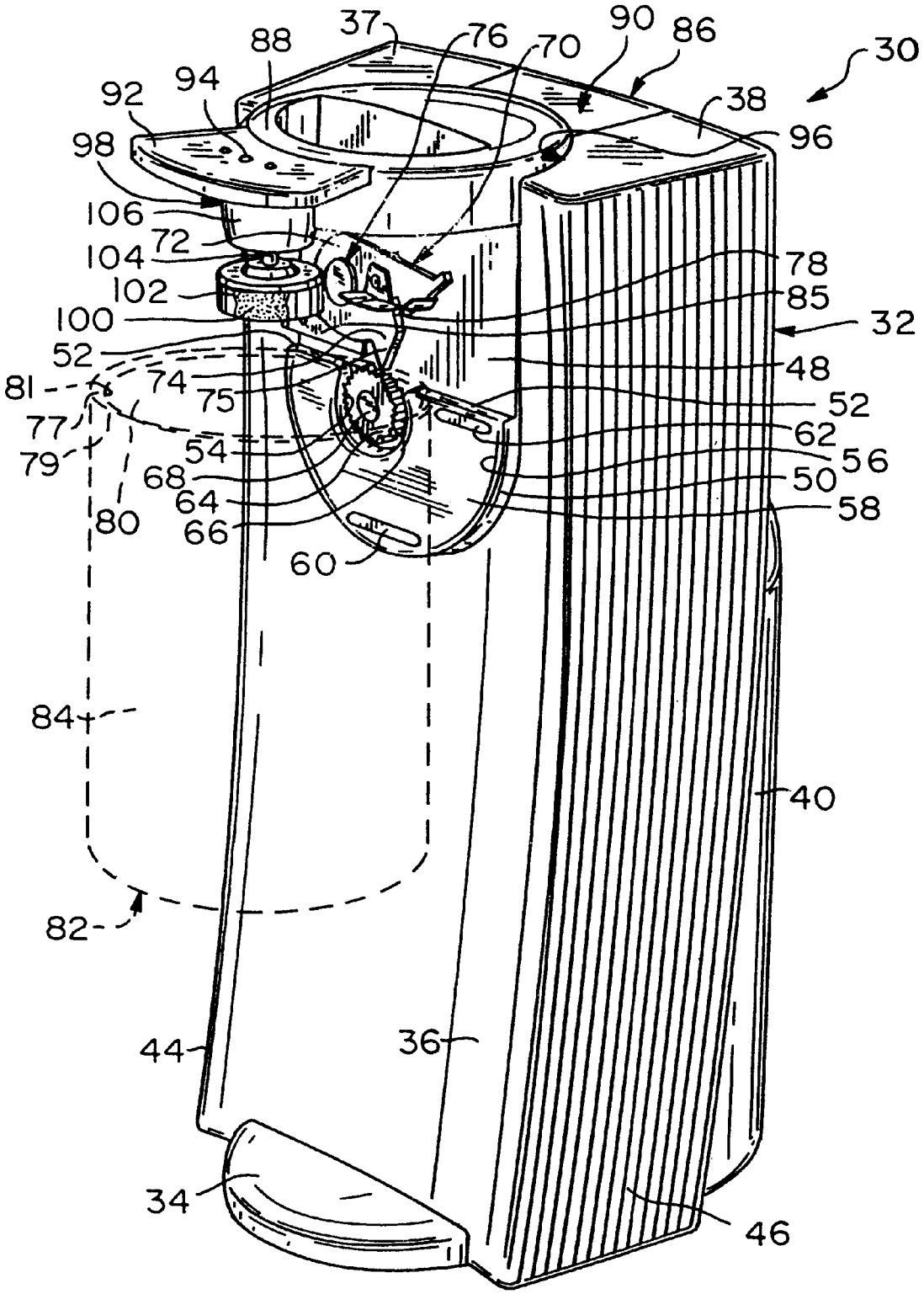
FIG. 1 is a perspective view showing a can opener having a drive wheel and a cutter mounted on a working face of a housing thereof, and further showing an actuator on an upper face of the housing, all in accordance with certain principles of the invention.
Figure 2:
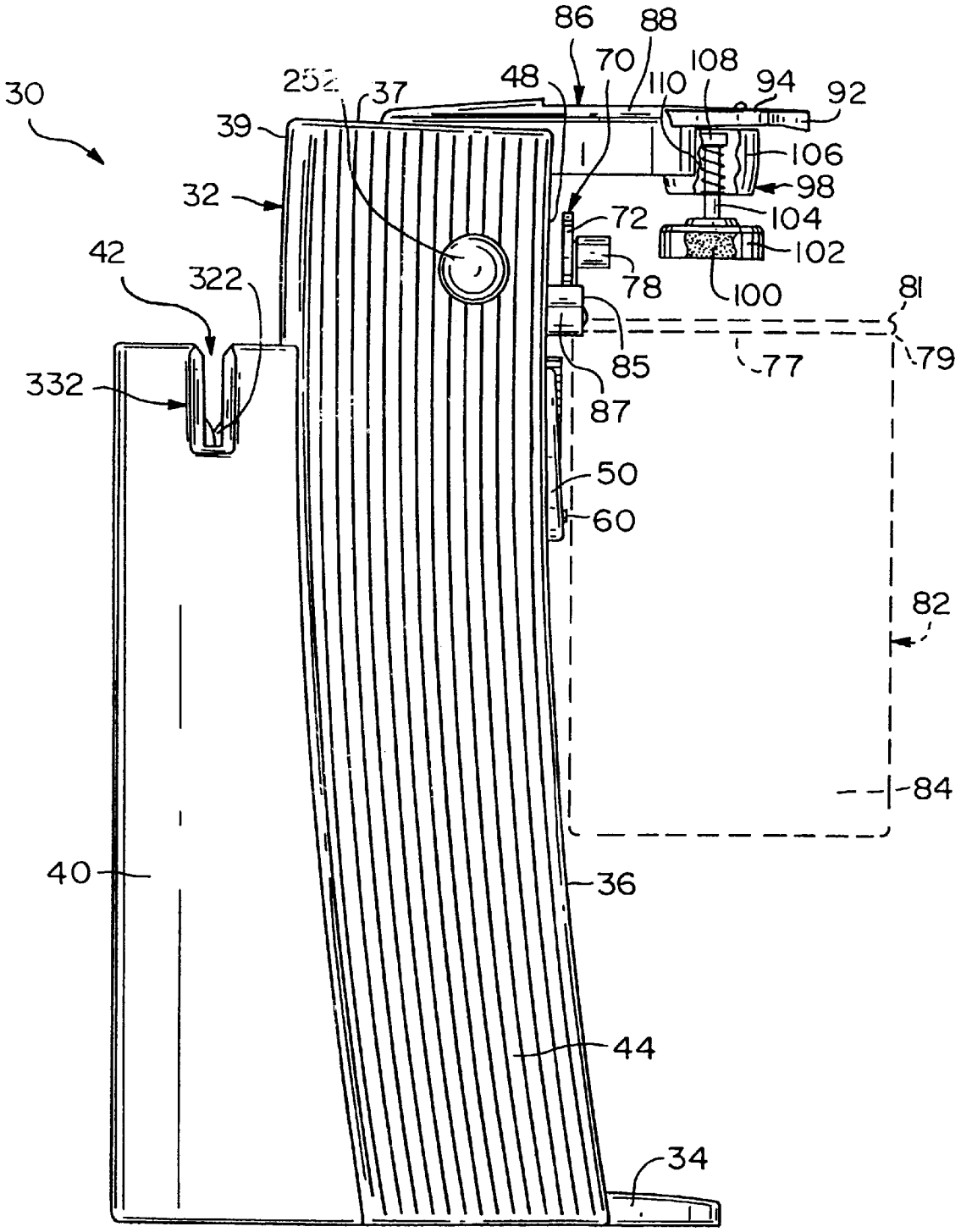
FIG. 2 is a side view showing the can opener of FIG. 1 in accordance with certain principles of the invention.

Referring to FIGS. 1 and 2, a can opener 30 includes a housing 32 formed with a foot 34, a front wall 36, spaced upper walls 37 and 38, a rear panel 39 with a rear extension 40 which houses a blade sharpener 42, and opposite side walls 44 and 46. A working face 48 is formed on the front wall 36 of the housing 32 and extends outward from the front wall. A semi-circular fence 50 extends outward from a lower portion of the working face 48 and joins with a split ledge 52 at opposite ends of the fence, with the split ledge being in a horizontal plane when the can opener 30 is in the orientation shown in FIGS. 4, 5 and 6. A U-shaped fence 54 is formed on the working face 48 and interrupts the ledge 52 along the middle thereof and joins the ledge at opposite ends thereof. The fences 50 and 54, and the ledge 52, form an enclosure 56 which receives an insert 58 having a pair of spaced ribs 60 and 62 extending outward therefrom. The ribs 60 and 62 are parallel with the ledge 52.

A drive wheel 64, formed with V-shaped teeth 66 extending radially outward therefrom, is mounted on a rotatable post 68 which extends from the working face 48 of the housing 32, and is located within a space formed by the U-shaped fence 54. At any time during ultimate rotation of the drive wheel 64, an upper portion of the rotating drive wheel is always located above the horizontal plane of the split ledge 52.

A cutter assembly 70 includes a cutter plate 72, having a cutter 74 and piercing tip 75 formed thereon, which is fixedly secured to one end of a rotatable shaft 76 extending from the working face 48. A slightly flexible spring plate 78 is attached to the cutter plate 72 above the cutter 74 and, in an unflexed state, extends generally perpendicularly from a front face of the cutter plate. A can 82 is shown in phantom in FIGS. 1, 2, 4, 5 and 6, and includes a can body 84, a can lid 80 and a rim 77 at the upper juncture of the body and the lid. The rim 77 extends radially from, and overhangs, the side of the can body 84 and is formed with a lower edge 79 and an upper edge 81.

A can support plate 85 is mounted on a boss 87 which extends from the working face 48. A space is formed between the plate 85 and the working face 48 with the cutter plate 70 located in the plane of the space. When the can opener 30 is operating in a lid-cutting mode, the cutter 74 is located in the space behind the support plate 85.

An actuator 86 is located between split portions of the upper walls 37 and 38 and includes a circular center section 88, a rear section 90 extending from the circular section, and a grip tab 92 extending from a forward portion of the circular section. The rear section of the actuator 86 is formed with a rear face 91. The grip tab 92 is covered with a soft plastic material for ease of gripping by a user of the can opener 30 and is formed with three raised bumps 94. The rear half of the circular section 88 and the rear section 90 fit into a complementary recess 96 formed between the upper walls 37 and 38 of the housing 32. The forward half of the circular section 88 and the grip tab 92 extend outward from the workface 48 when the actuator is in the position shown in FIGS. 1 and 2.

Figure 3:
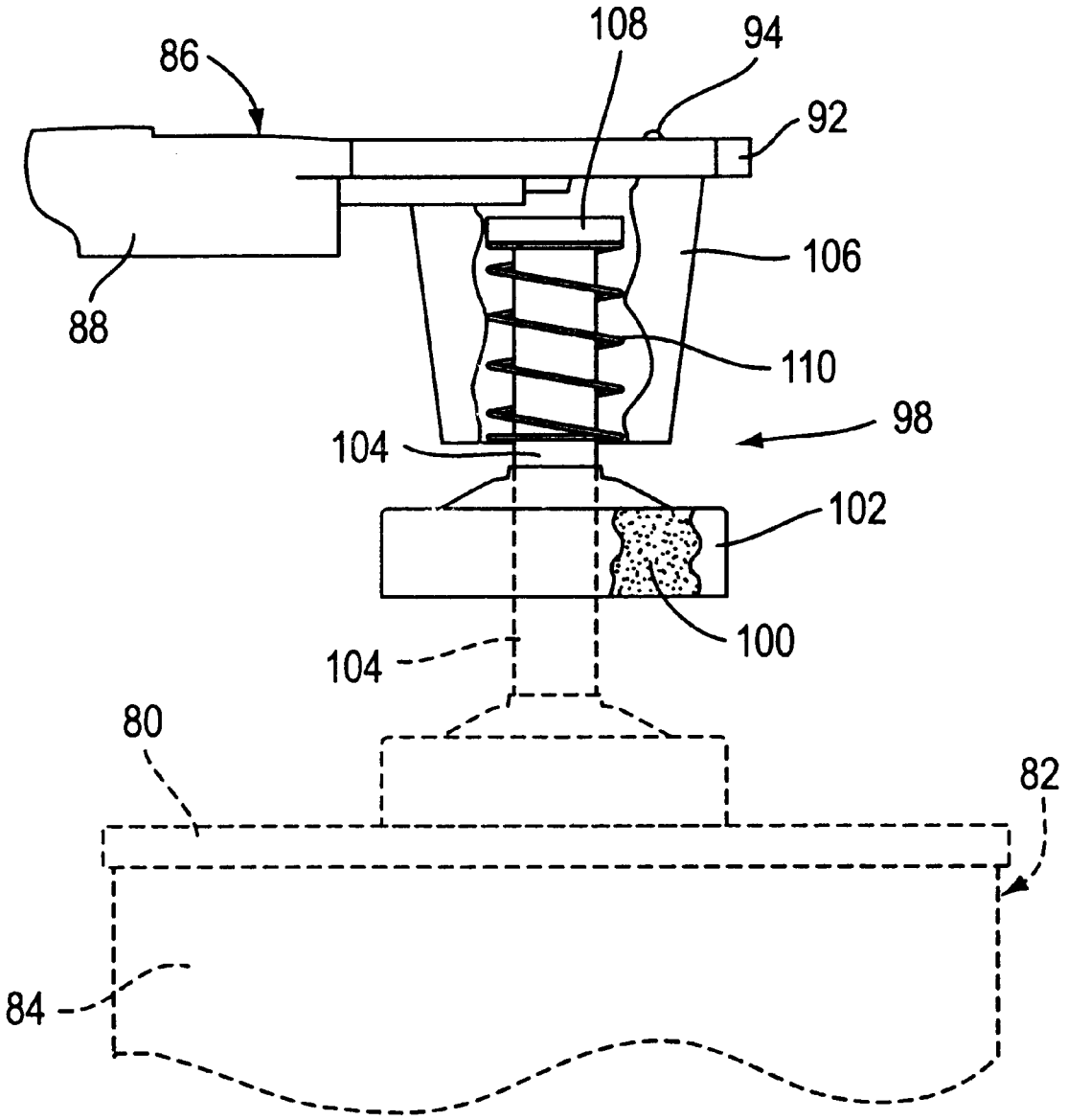
FIG. 3 is a partial perspective view showing a permanent magnet and a holder therefor in assembly with the underside of the actuator of FIG. 1 in accordance with certain principles of the invention.
Figure 16:
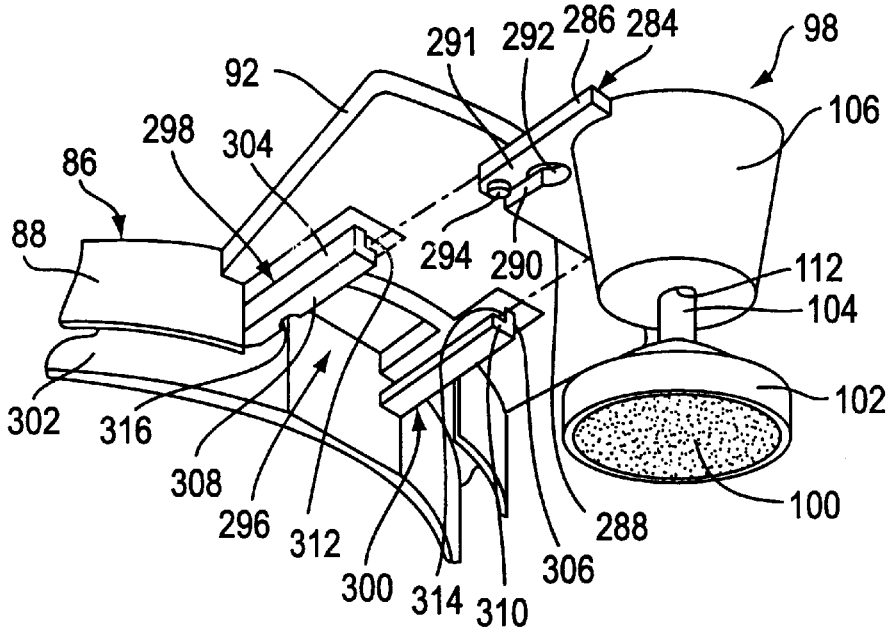
FIG. 16 is a partial perspective view showing the underside of a grip tab of the actuator, the permanent magnet and holder therefor of FIG. 3, and structure on the actuator and the holder for assembling the magnet and holder with the actuator in accordance with certain principles of the invention.

As shown in FIGS. 1, 2 and 3, a magnet assembly 98 includes a permanent magnet 100 secured within an inverted cup 102 having a stem 104 extending upward into a hollow holder 106. As further shown in FIGS. 2 and 3, the upper end of the stem 104 is formed with a head 108 which is biasingly retained within the holder 106 by a spring 110. As shown in FIG. 16, the stem 104 is formed with an oval cross section which is movably mounted in a complementary oval opening 112 formed in the holder 106 which permits the stem to move axially within the opening but precludes any rotary motion of the stem. Thus, the magnet 100, and any can lid 80 held thereto and separated from the can body, are also precluded from rotating. Also, as shown in FIG. 3, the stem 104 and the holder 106 are each formed with an axial height which allows the magnet 100 to extend a considerable distance below the holder as shown in dotted lines to engage the lid 80 of the can 82 during a lid cutting operation.

Figure 7:
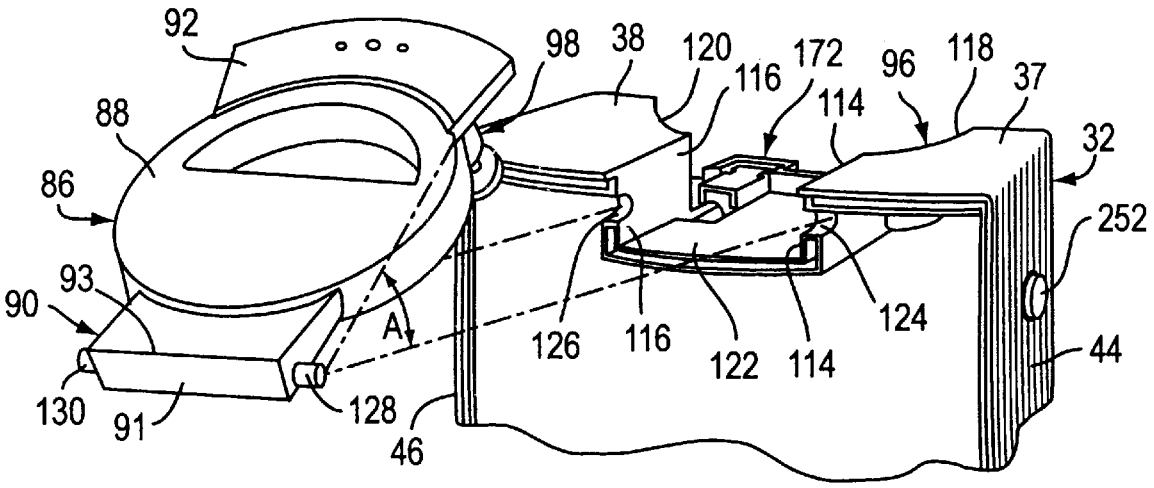
FIG. 7 is a partial, exploded, perspective view of the can opener of FIG. 1 showing structural features for mounting the actuator to the housing in accordance with certain principles of the invention.

As shown in FIG. 7, the recess 96 is formed by a pair of spaced side walls 114 and 116, contiguous with and extending from a rear end to intermediate portions of the upper walls 37 and 38, respectively. The recess 96 is further formed by a pair of spaced arcuate walls 118 and 120 which join with the side walls 114 and 116, respectively, at the intermediate portions of the upper walls 37 and 38, respectively. The arcuate walls 118 and 120 are also contiguous with the upper walls 37 and 38, respectively. The recess 96 is also formed with a floor wall 122 which is parallel with the upper walls 37 and 38, and extends between the bottom of the side walls 114 and 116, and the arcuate walls 118 and 120. A pair of generally horizontal slots 124 and 126 are formed in the side walls 114 and 116, respectively. Each of the slots 124 and 126 is formed with a prescribed depth as measured from an opening of the slot at the rear of the respective walls 114 and 116 toward the front thereof.

Figure 8:
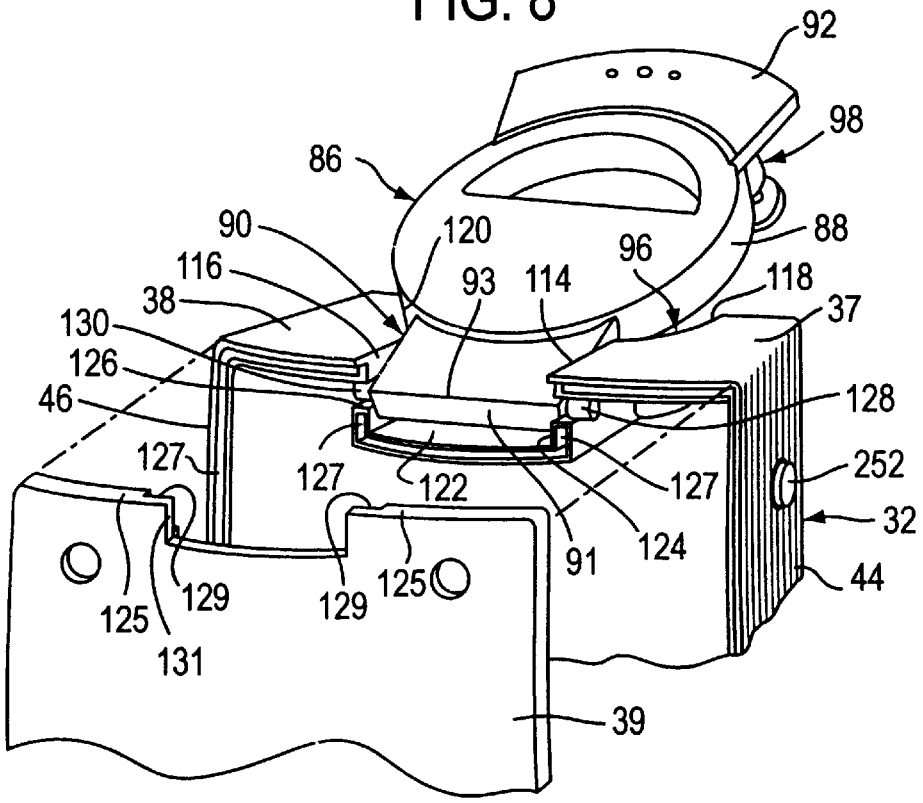
FIG. 8 is a partial, exploded, perspective view of the can opener of FIG. 1 showing the actuator mounted on the upper surface of the housing in accordance with certain principles of the invention.

Referring to FIGS. 7 and 8, a pair of pivot pins 128 and 130 are formed on the actuator 86 and extend from opposite sides of the rear section 90 near the rear thereof. The prescribed depth of the slots 124 and 126 is generally equal to the diameter of the pivot pins 128 and 130. This physical arrangement allows the pivot pins 128 and 130 to be located as far to the rear of the housing 32 as possible. With the rear panel 39 (FIG. 8) removed, the pivot pins 128 and 130 are aligned with the opening ends of the slots 124 and 126, respectively, and the actuator 86 is moved toward the slots whereby the pins seat in the slots as shown in FIG. 8. The rear panel 39 is then attached in its assembled location as an element of the housing 32. The actuator 86 is now attached to the housing 32 for pivoting movement relative thereto.

It is noted that the inboard side of the rear panel 39 is formed with a network of edge ribs 125 which fit into respective grooves 127 formed in a rear edge of the housing 32 to preclude lateral shifting of the panel after the panel has been secured to the housing. Due to a discontinuation of the ribs 125 on selected portions of the inboard side of the rear panel 39, clearance surfaces 129 are located adjacent opposite sides of a wide notch 131 formed centrally in an upper portion of the rear panel. When the rear panel 39 is assembled with the housing 32, the clearance surfaces 129 fit snugly over the openings of the slots 124 and 126 to prevent transaxial movement of the pivot pins 128 and 130. Further, the discontinuation of the ribs 125 in the area of the clearance surfaces 129 also allows the pivot pins 128 and 130 to be mounted as close to the rear of the housing 32 as possible. The notch 131 is formed with a width dimension and a height dimension which is generally comparable to the width and height dimensions of the rear face 91 of the rear section 90 of the actuator 86. This arrangement allows the rear face 91 to be flush with the adjacent outer surface portions of the rear panel 39. Also, when the actuator 86 is moved to the fully raised position, clearance is provided by the notch 131 for an upper rear edge 93, and upper adjacent portions of the rear face 91, of the rear section 90 to be angularly positioned outward relative to the flush position of the rear face with the adjacent outer surface portions of the rear panel 39. The arrangement of the notch 131 and the rear face 91, as described above, further provides for the locating of the actuator 86 in its rearward-most position.

The location of the slots 124 and 126, the prescribed depth of the slots, the placement of the rear panel 39 over the openings of the slots, the absence of the ribs 125 at the clearance surfaces 129, and the arrangement of the notch 131 and the rear face 91 all combine to provide the rearmost pivoting axis for the pivot pins 128 and 130. This structure allows the actuator 86 to pivot upward to the fully raised position by an angle "A" (FIG. 7) in a range of forty-five degrees to fifty degrees as measured at the pivot axis of the pins 128 and 130 at the rear of the housing 32. In this manner, the forward portions of the actuator 86 are positioned significantly above the working face 48, the insert 58, the drive wheel 64 and the cutter 74, thereby providing an unobstructed view for the user when loading and unloading the can 82 with respect to the can opener 30.

As shown in FIGS. 4 and 8, the actuator 86 has been pivoted upward into a can loading, or fully raised, position whereby the drive wheel 64 and the cutter 74 are clearly visible to the user of the can opener 30. The can 82 is assembled with the can opener 30 by placing the lower edge 79 of the rim 77 of the can upon the top of the drive wheel 64 and behind the can support plate. If the assembled can 82 is generally cylindrical and oriented axially in a vertical direction, an intermediate portion of the can body 84 will rest on the rib 60 (FIG. 2) formed on insert 58 (FIG. 1). If the can is of another shape which is wide, but not particularly deep, such as, for example, a typical sardine can, the assembled can will rest on the rib 62 which is also formed on the insert 58. In either instance, the ribs 60 and 62 provide a lateral levelling support to maintain the can in an orientation which facilitates an efficient and effective cutting of the can lid 80.

Referring to FIGS. 1, 2 and 5, after assembling the can 82 with the can opener 30, the user pivots the actuator 86 to a cutter pre-load, or partially lowered, position whereby the piercing tip 75 of the cutter 74 is moved into engagement with the lid 80 of the can 82 in preparation for the eventual piercing of the lid. In addition, as the cutter 74 is lowered onto the can lid 80, the spring plate 78, in the unflexed state, is moved to a position adjacent and above the upper edge 81 of the rim 77 of the can 82.

Figure 6:
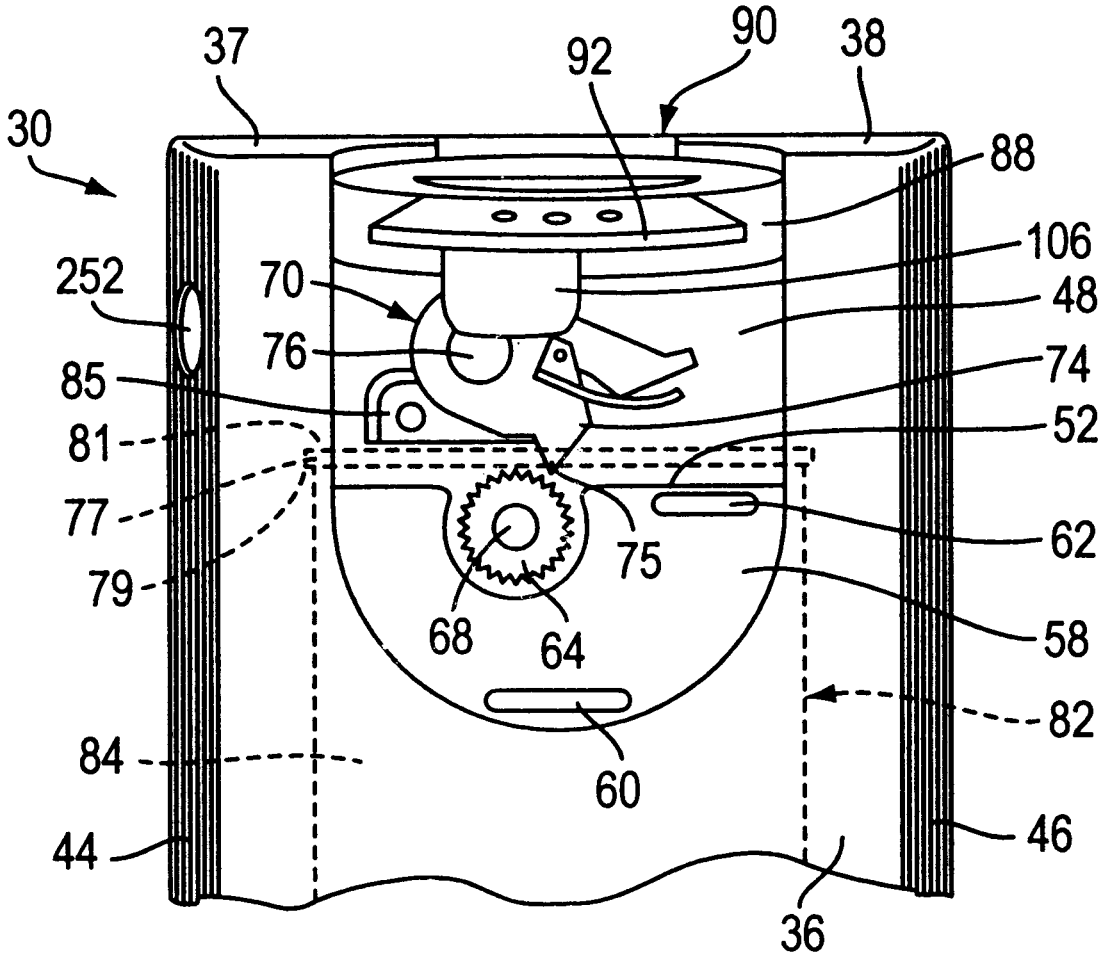
FIG. 6 is a partial front view of the can opener of FIG. 1 showing the actuator and the cutter in a lid cutting, or fully lowered, position in accordance with certain principles of the invention.

Referring to FIG. 6, the user then continues the lowering movement of the actuator 86 to a lid cutting, or fully lowered, position where the piercing tip 75 of the cutter 74 pierces the lid 80 of the can 82. At the same time, the spring plate 78 engages the upper edge 81 of the rim 77 and is flexed to thereby biasingly urge the can 82 downward so that the V-shaped teeth 66 of the drive wheel 64 bite into the lower edge 79 of the rim. In this manner, the spring plate 78 serves to insure firm engagement of the rim 77 of the can 82 with the teeth 66 of the drive wheel 64 during a lid-cutting mode of the can opener 30, and also serves to stabilize the position of the can during this same period. Further, when the spring plate 78 is urged against the rim 77 of the can 82, the spring plate is flexed to some extent thereby storing biased energy in the plate.

When the user pivots the actuator 86 to the lid cutting position, the permanent magnet 100 is magnetically attracted to and engages a central portion of the top of the lid 80. Also, the can opener 30 is activated to drive or rotate the drive wheel 64 whereby the can 82 is rotated relative to the cutter 74 which cuts the lid 80 just to the inside of the rim 77.

When the lid 80 has been fully severed from the can body 84, the user of the can opener 30 releases the actuator 86. The energy stored in the flexed spring plate 78 is now released and provides some assistance in the automatic return of the actuator 86 to the partially lowered position illustrated in FIGS. 1, 2 and 5, and the rotation of the drive wheel 64 ceases. Other facilities to be described hereinafter provide the major force in the automatic return of the actuator 86 to the partially lowered position.

The actuator 86 is then moved to the fully raised position to clearly reveal the lid-less can 82 with the cutter 74 and the spring plate 78 being displaced from engagement with any portions of the can. Also, the severed lid 80, which is attached to the magnet 100, has been moved well above the lid-less can 82 because of the attachment of the magnet assembly 98 with the underside of the grip tab 92 of the actuator 86. By virtue of the oval stem 104 and the oval opening 112 of the magnet assembly 98, the lid 80, which is now attached to the permanent magnet 100, will not spin or rotate in a hazardous manner, and can be easily separated from the magnet by the user and discarded. The lid-less can 82 can now be removed from assembly with the can opener 30.

With the actuator 86 being mounted at the rear of the housing 32 for pivoting movement, by virtue of the location of the pivot pins 128 and 130, the actuator can be pivoted substantially clear of the area around the working face 48 in the can loading mode. This feature provides clear visibility for the user to assemble the can 82 with the can opener 30 with relative ease. In addition, the location of the pivot axis along the axis of the pins 128 and 130 at the rear of the housing 32 provides an extended leverage action which lightens the effort required by the user to operate the can opener 30 during the lid-piercing and lid-cutting modes.

Figure 9:
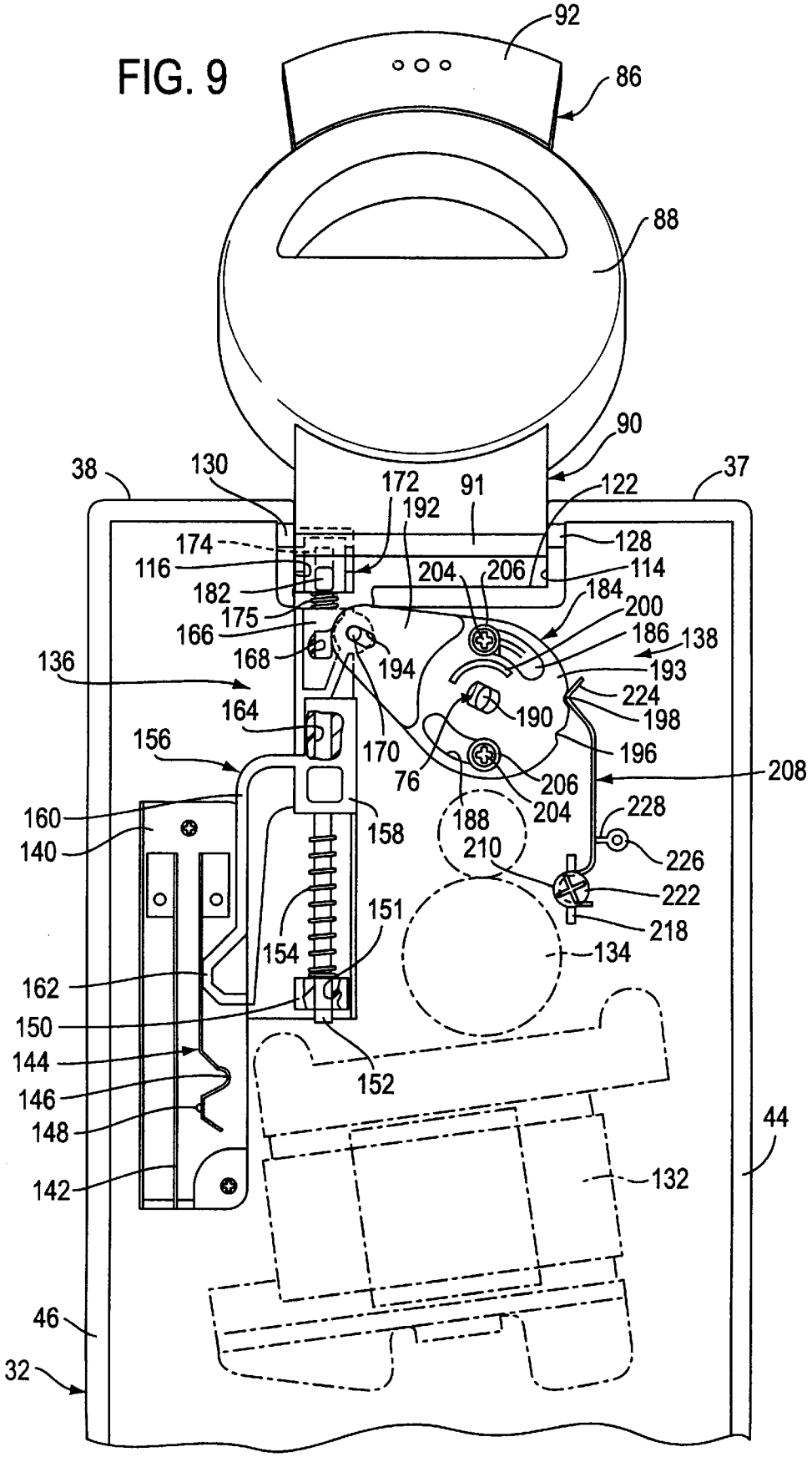
FIG. 9 is a rear view of the can opener of FIG. 1 with a rear panel of the housing removed to show the positioning of internal switching and detent structures when the actuator is in the can loading, fully raised, position of FIG. 4 in accordance with certain principles of the invention.
Figure 10:
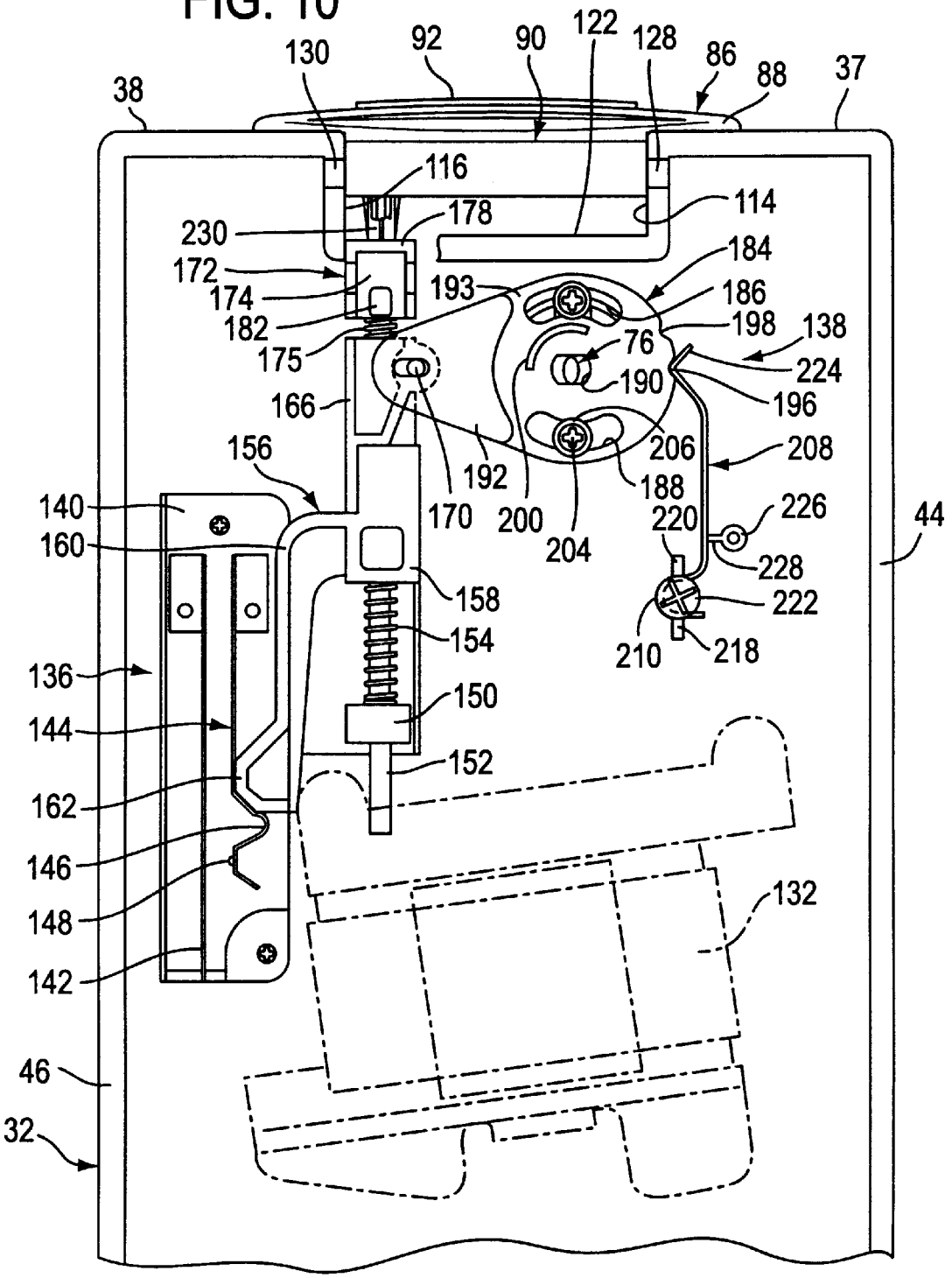
FIG. 10 is a rear view of the can opener of FIG. 1 with the rear panel of the housing removed to show the positioning of the internal switching and detent structures when the actuator is in the cutter pre-load, or partially lowered, position of FIG. 5 in accordance with certain principles of the invention.
Figure 11:
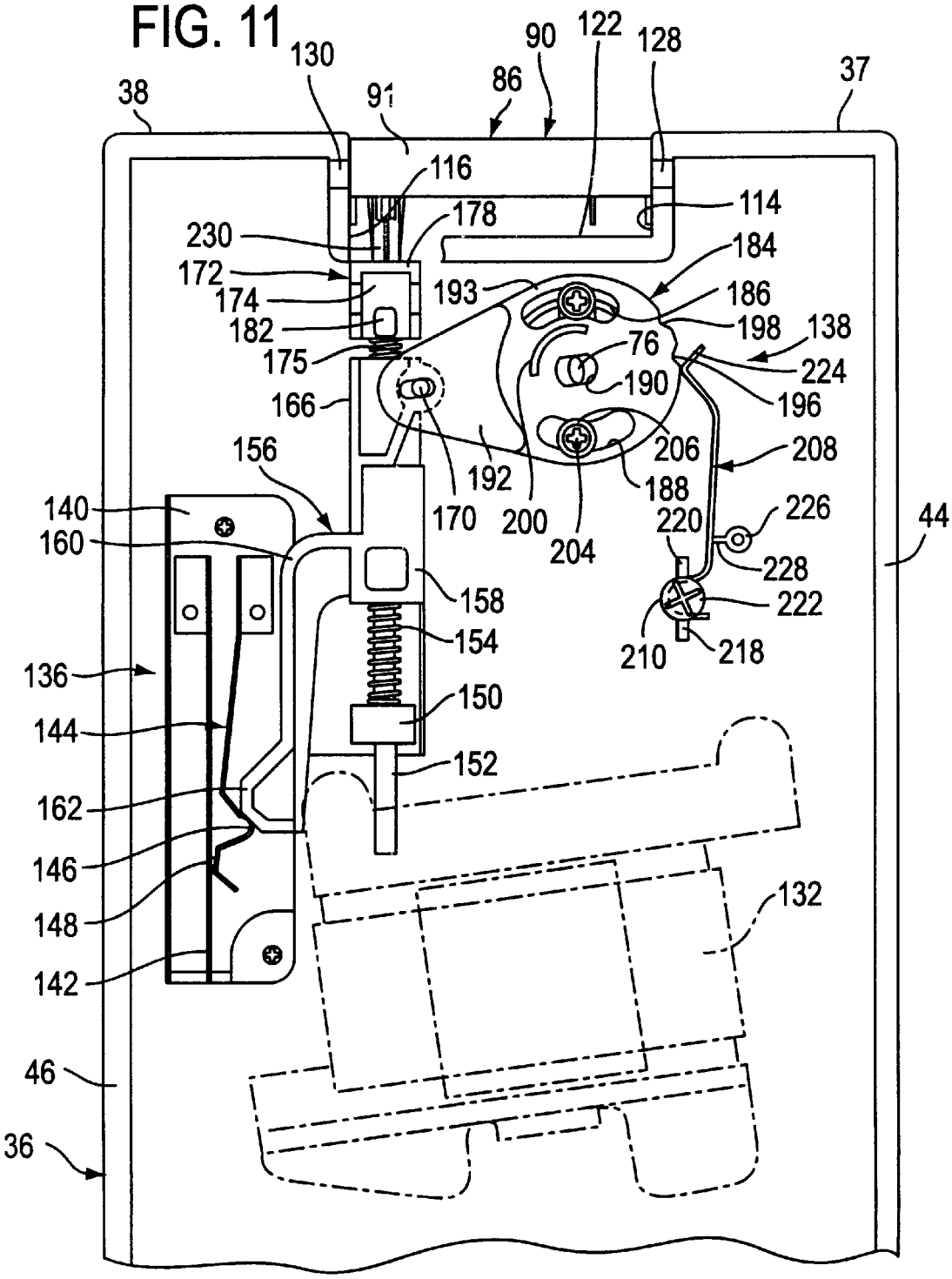
FIG. 11 is a rear view of the can opener of FIG. 1 with the rear panel of the housing removed to show the positioning of the internal switching and a detent structures when the actuator is in the lid cutting, or fully lowered, position of FIG. 6 in accordance with certain principles of the invention.

Referring to FIGS. 9, 10 and 11, the rear panel 39 (FIG. 8) has been removed to reveal a drive motor 132 and a gear train 134, both of which are shown in phantom, for providing driving energy for the drive wheel 64 at selected times. A switching mechanism 136 is also shown and is arranged to be operated when the actuator 86 is moved to, and is in, the lid cutting, or fully lowered, position to facilitate the application of electrical energy to the motor 132 for operation thereof. A cutter plate mover and actuator detent mechanism 138 is also shown and provides facility for locating the actuator 86 at the can loading and cutter pre-load positions, in conjunction with the positioning of the switching mechanism 136.

The switching mechanism 136 includes a support 140 which is attached to an inner wall of the housing 32 and which supports a pair of normally spaced, or open, spring contacts 142 and 144, generally parallel to each other. The contact 142 is flat and extends downward from its attachment with the support 140. The contact 144 extends downward from its attachment with the support and is generally flat except for a crimp 146 formed in a lower portion thereof and a contact button 148 adjacent the crimp and facing the contact 142.

The switching mechanism 136 further includes a boss 150 which is formed with and extends from the support 140 and is formed with a through hole 151 for receipt of a rod 152, which is movable through the hole of the boss. A spring 154 is positioned over the rod 152 and rests, at the bottom thereof, on a top surface of the boss 150. A switch closer 156 is formed with a slide member 158, a support arm 160 and a cam 162. The slide member 158 is formed with a through hole 164 for receipt of the rod 152 therethrough and is sized to allow movement of the rod relative thereto.

Figure 12:
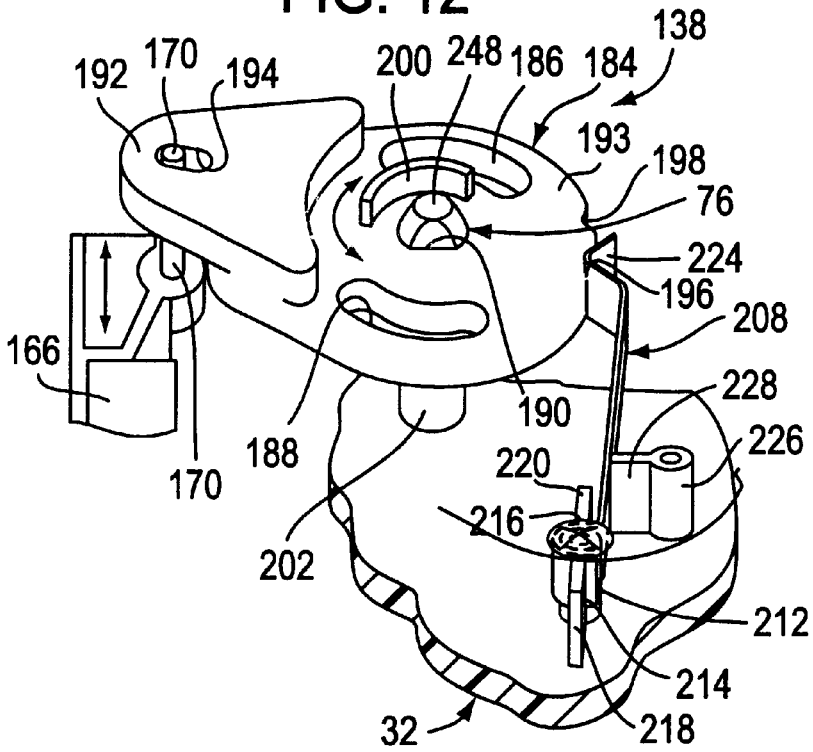
FIG. 12 is a perspective view showing the detent structure of FIGS. 9, 10 and 11 in accordance with certain principles of the invention.

The switching mechanism 136 also includes a motion transfer member 166 which is formed with a through hole 168 for receipt of the rod 152 therethrough and is sized to allow movement of the rod relative thereto. The motion transfer member 166 is also formed with a coupling pin 170 (FIG. 12). The motion transfer member 166 is assembled with the slide member 158 so that the respective holes 168 and 164 are axially aligned for receipt of the rod 152 through the aligned holes. An actuating member 172 is located above the motion transfer member 166 and is formed with a closed end hole 174 (FIG. 13) having an opening in the bottom face thereof which faces the motion transfer member. The hole 174 of the actuating member 172 has a diameter which is less than the diameter of the rod 152 and receives an upper end of the rod in a force-fit manner so that the rod is thereby attached to the actuating member. A spring 175 is located about the rod 152 and between the motion transfer member 166 and the actuating member 172 to maintain the members 166 and 172 in a spaced relationship on the rod.

Figure 13:
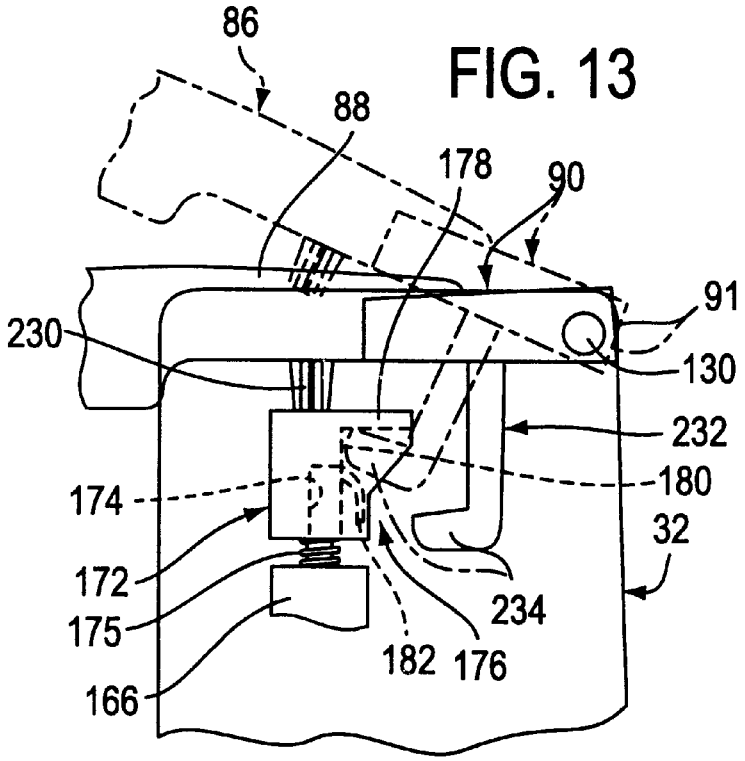
FIG. 13 is a partial side view with a side panel removed to show a lift tab formed on the underside of the actuator for engagement with a tab receptor which forms a portion of the internal switching structure in accordance with certain principles of the invention.

As also shown in FIG. 13, the actuating member 172 is formed with an open well 176 having a roof wall 178 and a rear wall 180. A tab 182 is formed at one end thereof with the rear wall 180 and extends outward and downward from the rear wall to a free end thereof in an unstressed state. The free end, and adjacent portions, of the tab 182 are sufficiently flexible to allow the free end and adjacent portions to be flexed and biased inward when an appropriate force is applied thereto, but will return to the unstressed state when the force is removed.

As shown in FIGS. 9 through 12, the cutter plate mover and actuator detent mechanism 138 includes a disc 184 having a pair of arcuate slots 186 and 188, and a central hole 190, formed therethrough. The central hole 190 is formed with straight opposed sides and rounded ends. An extension 192 is formed partially on one surface 193 of the disc 184 and extends from the one surface and an adjacent side of the disc. The extension 192 is also formed with an elongated slot 194 which is positioned to receive a free end portion of the coupling pin 170 of the motion transfer member 166. A pair of spaced dimples 196 and 198 are formed in an edge of the disc 184 on a side opposite the location of the extension 192. An arcuate fence 200 is formed on the surface 193 of the disc 184 between the central hole 190 and portions of the slot 186 and the extension 192.

As shown in FIG. 12, a pair of bosses 202 (one shown) are formed on and extend from an inside wall of the housing 32 and are located such that the slots 186 and 188 are located over the bosses when the cutter plate mover and detent mechanism 138 is assembled within the housing 32. As shown in FIG. 9, a pair of screws 204 and a respective pair of washers 206 are assembled with the mechanism 138 with the screws passing through the arcuate slots 186 and 188 and threadedly into the bosses 202. The washers 206 have an outside diameter which is larger than the width of the slots 186 and 188 and thereby facilitate the capture of the disc 184 between the housing 32 and the washers. The screws 204 are assembled loosely to allow the disc 184 to be moved readily within the limits permitted by the end-to-end movement of the screws between opposite ends of the arcuate slots 186 and 188.

A generally flat detent arm 208 is formed at one end 210 thereof in a generally U-shaped configuration which fits around a boss 212 extending from the inside of the housing 32. The U-shaped end 210 also fits into a pair of slots 214 and 216 formed in a pair of wings 218 and 220, respectively, which extend radially from opposite sides of the boss 212. A screw and washer assembly 222 (FIG. 9) is threadedly mounted on the boss 212 to retain the end 210 of the arm 208 in assembly with the boss.

The opposite end of the detent arm 208 is formed with a curved section 224 which is contoured to fit into the dimples 196 and 198 formed in the edge of the disc 184. A boss 226 is formed on and extends from the inside of the housing 32 and includes a tension arm 228 which engages one side of an intermediate portion of the detent arm 208 to urge the curved section 224 thereof into the dimples 196 and 198 when the disc 184 is appropriately positioned.

As shown in FIG. 4, when the actuator 86 is in the can loading, or fully raised, position, the actuating member 172 is protruding partially through an opening formed through the floor wall 122 of the recess 96. A push element 230, shown in FIGS. 4 and 13, is formed on the underside of the circular section 88 of the actuator 86. The push element 230 is positioned to engage and move the actuating member 172 into the housing 32 when the actuator 86 is moved to the cutter pre-load, or partially lowered, position, to facilitate positioning of the cutter 74 in engagement with the lid 80. When the actuator 86 is moved to the lid cutting, or fully lowered, position, the push element 230 moves the actuating member 172 further into the housing 32 to initiate operation of the lid cutting process.

As shown in FIG. 13, a lift arm 232 is formed at an upper end thereof with the underside of the circular section 88 of the actuator 86. A laterally-extended finger 234 is formed at the opposite end of the lift arm 232.

Figure 14:
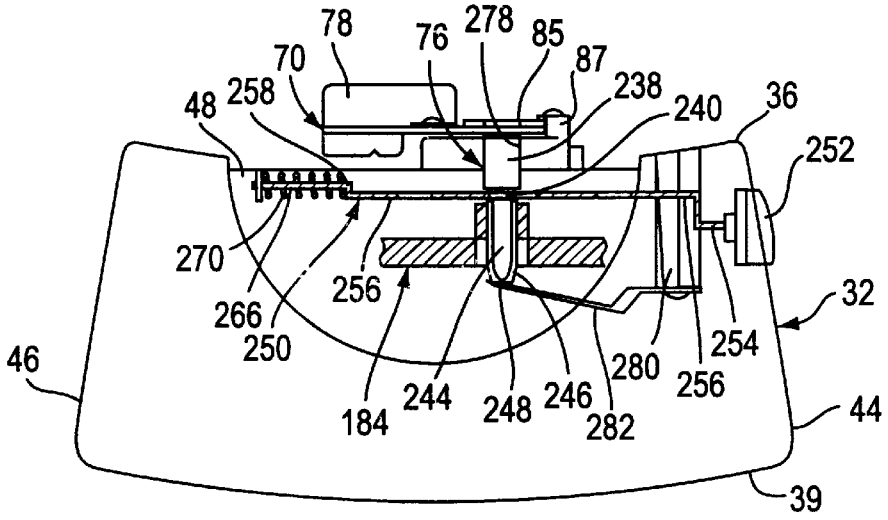
FIG. 14 is a top view of the can opener of FIG. 1 with a panel removed to show a mounting structure for removably supporting the cutter.
Figure 15:
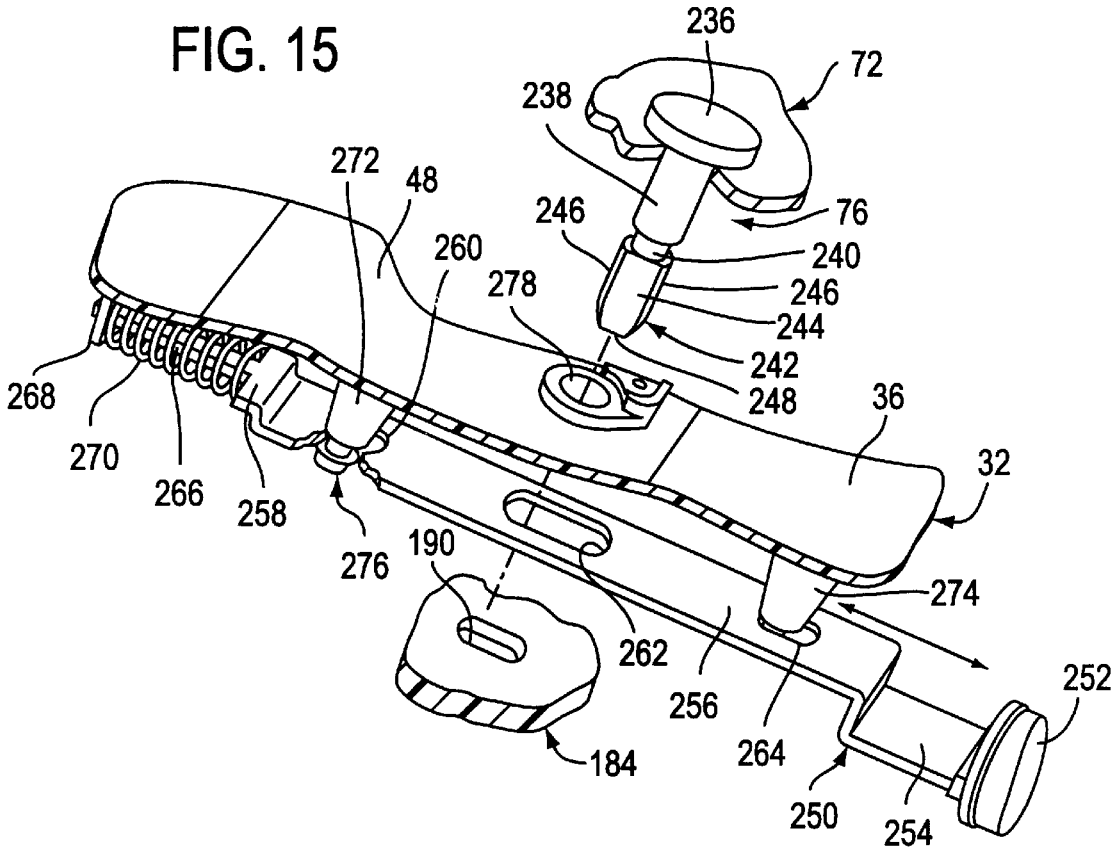
FIG. 15 is a perspective view showing the mounting structure of FIG. 14 for removably supporting the cutter.

Referring to FIGS. 14 and 15, the rotatable shaft 76 (FIG. 1), which is fixedly secured to-the cutter plate 72, is formed axially with a head 236 at a first axial end thereof, a cylindrical section 238 of a prescribed diameter, a reduced cylindrical section 240 of a diameter less than the prescribed diameter, and an opposite end section 242. The end section 242 is formed with two flat faces 244 (one shown in FIG. 15) on a first set of opposite sides of the end section and two rounded faces 246 on a second set of opposite side faces of the end section with the faces 244 being contiguous with the faces 246.

Axially outboard ends of the rounded end faces 246 are tapered axially inward toward a second end 248 of the shaft 76 which is formed with a flat face perpendicular to the axis of the shaft. The two flat faces 244 are separated by a distance which is generally equal to the diameter of the reduced section. The two rounded faces 246 are separated by a distance which is less than the prescribed diameter but greater than the diameter of the reduced section 240.

A spring-biased slide bar 250 is mounted within the housing 32 and is attached at one end thereof to a push button 252 which extends partially through and from the side face 44 of the housing 32. The bar 250 is formed with a first stepped section 254, a second stepped section 256 and a third stepped section 258 which are integrally joined to form the bar. The first stepped section 254 is attached to the button 252. As shown in FIG. 15, three spaced elongated holes 260, 262 and 264, respectively, are formed through the second stepped section 256.

A stem 266 extends in planar fashion from an outboard end of the third stepped section 258, with a free end of the stem extending through a hole formed through a support pad 268 formed with, and extending inward of, the housing 32. A spring 270 is positioned about the stem 266 and is captured between the outboard end of the third stepped section 258 and the support pad 268, and normally urges the slide bar 250 to the right as viewed in FIGS. 14 and 15. A pair of spaced stands 272 and 274 are formed with, and internally of, the housing 32 and extend to a position adjacent, but not within, the holes 260 and 264 of the second stepped section 256. A pair screw and washer assemblies 276 (one shown) are threadedly attached to the stands 272 and 274, with the screws located through the holes 260 and 264, respectively, and with the washers being located on one side of the stepped section 256 and the stands located on the opposite side of the stepped section. In this manner, the bar 250 is allowed to move laterally of the axes of the screws within the limits defined by the rounded ends of the elongated holes 260 and 264. As illustrated, the spring 270 is urging the slide bar 250 as far to the right as it is allowed to move. In this position, the button 252 is protruding from the side face 44 as shown in FIGS. 2 and 14.

When assembling the cutter plate 72 with the housing 32, the actuator 86 is moved to the fully raised position as shown in FIG. 4 and the cutter plate 72 is manipulated so that the cutter 74 is oriented to the position shown in FIG. 4. The second end 248 of the shaft 76 is then inserted into a hole 278 formed in the working face 48 of the can opener 30 as shown in FIG. 15. The diameter of the hole 278 is slightly larger than the prescribed diameter to allow the cylindrical section 238 to eventually be located in the hole.

Eventually, the second end 248 passes through the hole 278 and moves into the elongated hole 262 of the second stepped section 256 of the slide bar 250. When the slide bar 250 is urged to the position illustrated in FIG. 15 by the spring 270, the left rounded end of the hole 262 is slightly in the path of the shaft 76, and particularly the left curved face 246 of the hole, whereby the left curved face engages the left rounded end and urges the slide bar 250 to the left. The slide bar 250 remains in this position until the reduced cylindrical section 240 is aligned with the hole 262 whereafter the slide bar moves to the right, as viewed in FIG. 15, due to the radially inward recess formed by the reduced section relative to the left curved face 246 of the shaft 76.

As the reduced section 240 is approaching the hole 262 of the slide bar 250, the second end 248 of the shaft 76 is moving into and through the hole 190 formed in the disc 184, eventually to the position illustrated in FIGS. 12 and 14. As shown in FIG. 14, a post 280 is formed internally of, and with, the housing 32. A leaf spring 282 is attached at one end thereof to the post 280 with the other end being unattached and in position to engage the second end 248 of the shaft 76. With this arrangement, the leaf spring 282 urges the shaft 76 in an axially retractable direction. However, since the left rounded end of the hole 262 is urged into the recess of the reduced cylindrical section 240, the shaft remains in the assembled. Also, the hole 190 of the disc 184 is complementary to the cross-sectional shape of the opposite end section 242 of the shaft 76, whereby the opposite end section fits snugly into the hole so that the shaft, the cutter plate 72 and the cutter 74 will move about the axis of the shaft when the disc is rotated.

Figure 17:
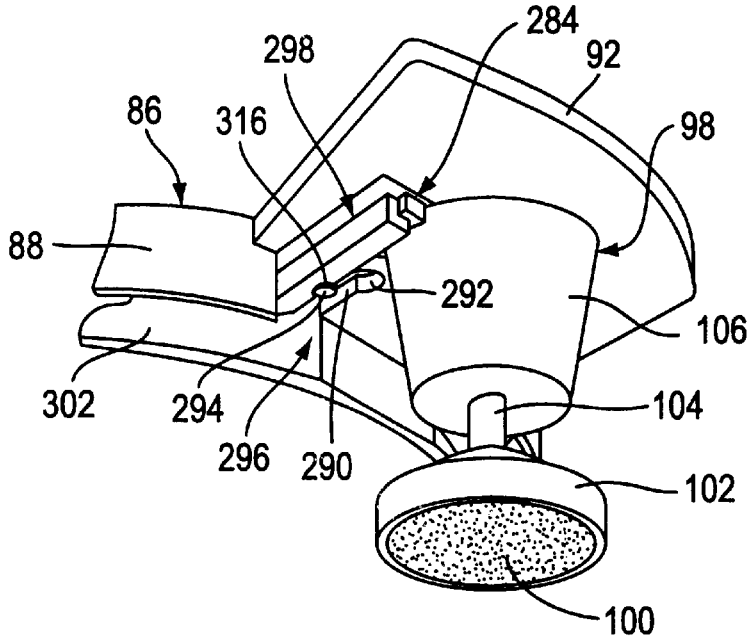
FIG. 17 is a partial perspective view showing the magnet and holder in assembly with the underside of the actuator in accordance with certain principles of the invention.

Referring to FIGS. 16 and 17, a shelf 284 is formed with and extends laterally from the top of the hollow holder 106. The shelf 284 is formed with a pair of opposite side edges 286 (one shown) and a forward edge 288. A slot 290 is formed in the forward edge 288 and extends toward the holder 106 with an enlargement 292 formed in the inboard end of the slot. The slot 290 is generally parallel with, and close to, the visible side edge 286 shown in FIG. 16, and results in the formation of a finger 291 defined by the edge 286 and the slot 290.

A circular knob 294 is formed on the underside of the finger 291 near the forward edge 288 of the shelf 284, and between the visible side edge 286 and the slot 290. A nest 296, for receiving and supporting the shelf 284, is located at the underside of the grip tab 92 of the actuator 86 and includes a pair of L-shaped rails 298 and 300 which are formed with the underside of the grip tab and, at inboard ends thereof, to an inner wall 302 of the circular center section 88. The pair of L-shaped rails 298 and 300 are spaced apart and are formed with upright legs 304 and 306, respectively, and lateral legs 308 and 310, respectively. The lateral legs 308 and 310 are directed toward each other to form a pair of spaced ledges 312 and 314, respectively, which eventually receive and support underside edge portions of the shelf 284. A semi-circular notch 316 is formed in an inboard edge of the lateral leg 308 of the rail 298, and is located a short distance from the inboard end of the rail.

When assembling the magnet assembly 98 within the nest 296, the shelf 284 is moved onto the ledges 312 and 314, and between the upright legs 304 and 306. As the shelf 284 is moved into the nest 296, the knob 294 engages the inboard, free edge of the leg 308 whereby the finger 291 and the knob are biased inward due to the lateral resiliency of the finger as provided by the slot, and enhanced by the enlargement 292. Eventually, the shelf 284 is fully inserted into the nest 296 where the knob 294 is biasingly urged into the notch 316 to removably retain the magnet assembly 98 within the nest 296. In order to remove the magnet assembly 98 from the nest 296, the hollow holder 106 is gripped and pulled in a direction away from the nest where, at a prescribed withdrawal force level, the knob 294 is urged out of the notch 316 to allow the removal of the shelf 284.

Figure 18:
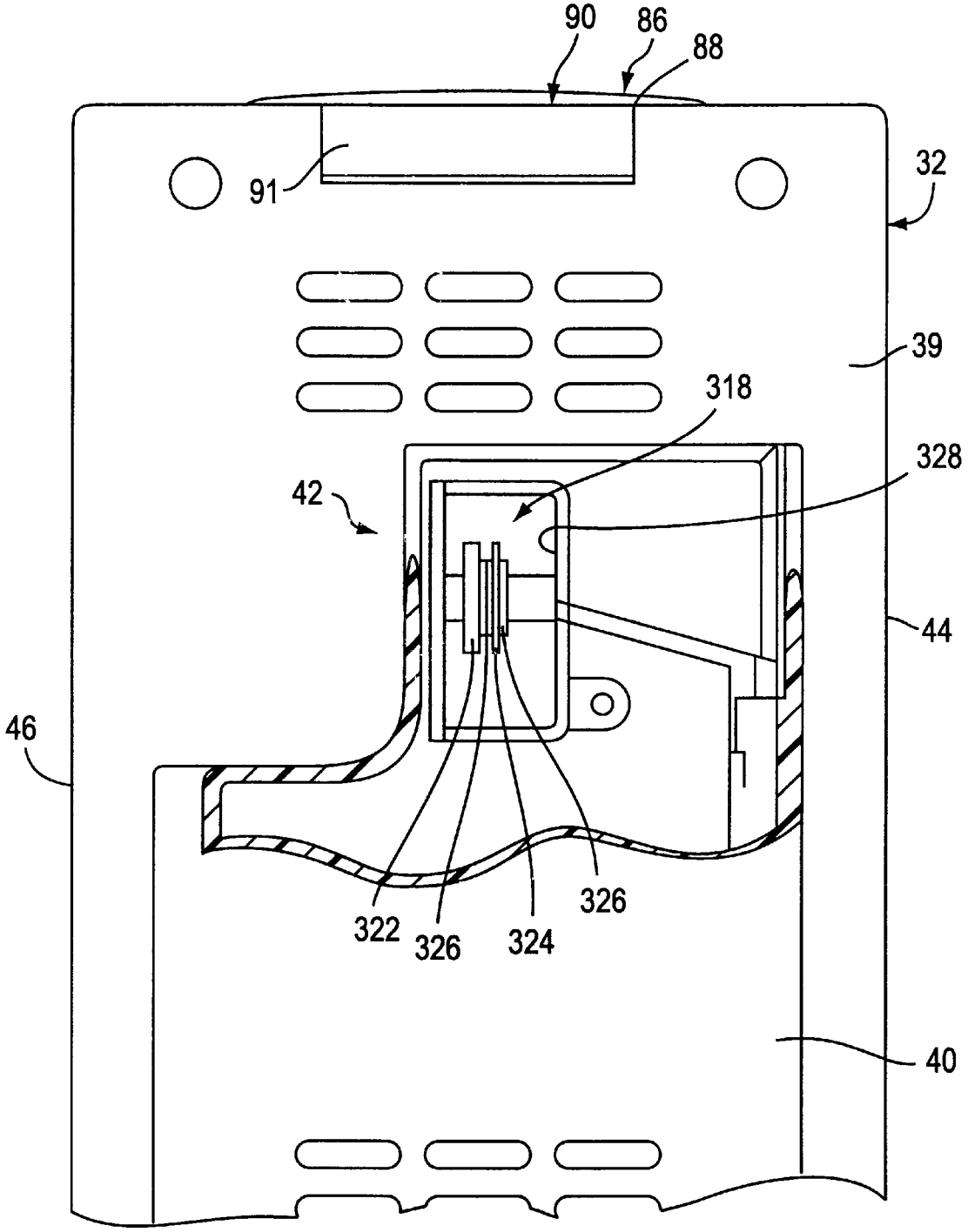
FIG. 18 is a rear view of the can opener of FIG. 1 with portions of the housing removed to show a blade sharpener located in the rear of the housing.
Figure 19:
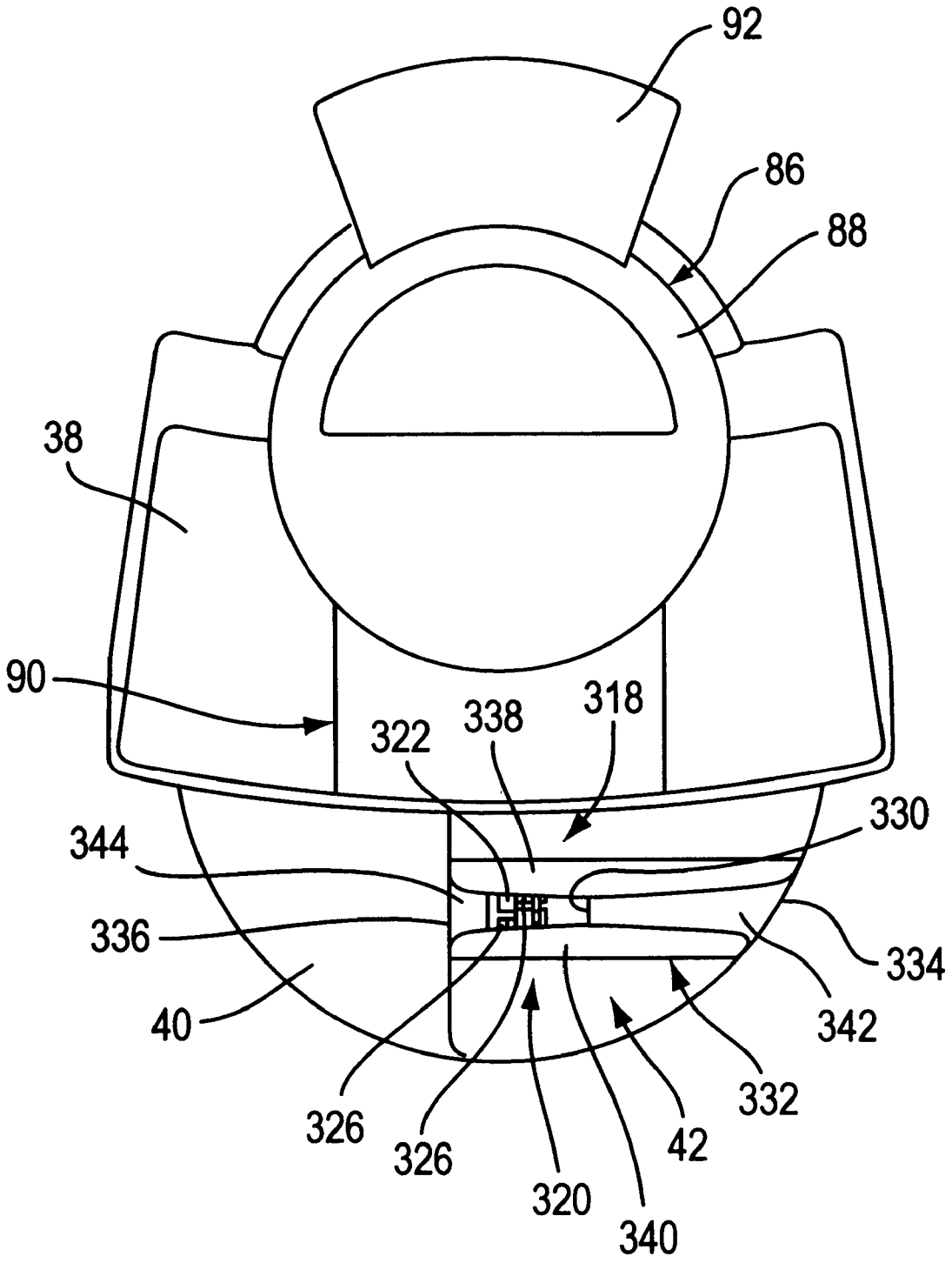
FIG. 19 is a top view of the can opener of FIG. 1 showing the blade sharpener of FIG. 18 located within a blade guideway.

Referring to FIGS. 18 and 19, the blade sharpener 42 is mounted in the rear extension 40 of the housing 32 and includes two sets 318 and 320 of discs. For illustration purposes, as shown in FIG. 18, the set 318 includes at least one ceramic sharpening disc 322, at least one metal sharpening disc 324 and a plurality of spacer discs 326. The set of discs 320 have a comparable number and types of discs as the set 318, but are arranged differently so that the ceramic discs of each set are stacked axially, and the metal discs are stacked axially. Each set 318 and 320 of the discs are mounted on a respective pin (not shown) thereby providing a common axis for the discs of the set. The pin-mounted discs of each set 318 and 320 are located within a compartment 328 which is formed with an opening 330 through and from which a portion of the sharpening discs extend to facilitate the sharpening of blades being passed therebetween.

A blade guide 332 is formed from a durable material, and generally in a U-shaped configuration from a blade entry end 334 to a blade exit end 336. The guide 332 includes a pair of spaced side walls 338 and 340, and a forward floor 342 and a rear floor 344 which are separated by the opening 330 to allow the portions of the sharpening discs to extend therethrough. Interfacing surfaces of the sidewalls 338 and 340, which are contiguous with the forward floor 342, flare inward from the entry end 334 to the opening 330, and the forward floor 342 ramps upward from the entry end to the opening to provide ample space for maneuvering the blade during a sharpening process. Further, the interfacing surfaces of the side walls 338 and 340, which are contiguous with the rear floor 344, flare outward from the opening 330 to the exit end 336 to further enhance the maneuvering of the blade during a sharpening process.

When preparing the can opener 30 for assembly of the can 82 therewith, the actuator 86 is raised to the position shown in FIG. 9, and in phantom in FIG. 13. During the raising of the actuator 86, the finger 234 engages the underside of the wall 178 and raises the actuating member 172 to the position shown in FIG. 9 whereby the switching mechanism 136 assumes the position illustrated in FIG. 9. In this position, the disc 184 is located to facilitate positioning of the curved section 224 of the detent arm 208 within the dimple 198. The placement of the curved section 224 within the dimple 198 provides an impediment to the downward movement of the switching mechanism 136 and also provides a tactile response to the user that the can loading or fully raised position of the actuator 86 has been attained. When the user releases the grip tab 92, the actuator 86 tends to pivot downward because the actuator is not physically attached to the switching mechanism 136 or the actuating member 172, and therefore is not precluded from such movement by the curved section 224 being located in the dimple 198. However, after the finger 234 has moved downward for a very short distance, it engages the outer surface of the tab 182 and prevents the actuator from further downward movement without any additional application of outside force such as, for example, by the user. Under these conditions, the retention force derived from the curved section 224 being located in the dimple 198 is sufficient to retain the actuator 86 and the switching mechanism 136 in the positions illustrated in FIG. 9. Thus, the actuator 86 remains in the fully raised position even though the user has released the grip tab 92.

Eventually, the user has placed the can 82 in position for the lid-cutting procedure. Thereafter, the user grips the grip tab 92 and moves the actuator 86 downward whereby the finger 234 depresses and biases the tab 182, and moves downward past the tab, whereafter the tab returns to the unstressed position. With continued downward force being applied to the actuator 86 by the user, the push element 230 engages the top of the actuating member 172 whereby the actuating member and the switching mechanism 136 are urged downward.

During the downward movement, the coupling pin 170 is moved to the position shown in FIG. 10, by virtue of the movement of the motion transfer member 166, resulting in the movement of the disc 184. During the movement of the disc 184, the curved section 224 of the detent arm 208 is moved out of the dimple 198 and is eventually located within the dimple 196. This results in an impediment to the free movement of the actuator 86 and the switching mechanism 136 beyond the position of the actuator, as shown in FIGS. 1, 5 and 10, and the switching mechanism, as shown in FIG. 10. Placement of the curved section 224 in the dimple 196 also provides a tactile response to the user of the can opener 30 that the cutter pre-load or partially lowered position has been attained. Since the opposite end section 242 of the shaft 76 is located within the central hole 190 of the disc 184, the shaft is moved about its axis when the disc is moved to move the cutter 74 to the position of engagement with the lid 80 of the can 82 as illustrated in FIGS. 1 and 5.

With continued downward force being applied to the actuator 86 by the user, the curved section 224 moves out of the dimple 196 to the peripheral edge of the disc 184, and the cutter 74 pierces the lid 80 of the can 82 as noted above and the magnet 100 is moved into engagement with the lid. Eventually, the actuator 86 is moved to the lid cutting or fully lowered position (FIG. 6) where the spring 154 is compressed and the push element 230 moves the switching mechanism 136 to the position illustrated in FIG. 11. In this position, the cam 162 of the switching mechanism 136 urges the button 148 of the crimped contact 144 into engagement with the straight contact 142, whereby electrical energy is coupled to, and operates, the motor 132. Upon operation of the motor 132, the drive wheel 64 is rotated which results in the rotation of the can 82 and the cutting of the lid 80. The user holds the actuator 86 in the fully lowered position until the lid 80 is fully cut from the can 82, whereupon the user releases the actuator.

Upon release of the actuator 86, the biased force of the compressed spring 154 urges the switching mechanism 136 upward to the partially lowered position only, as shown in FIGS. 5 and 10. During this period, the button 148 is moved away from engagement with the straight contact 142 to remove electrical energy from the motor 132 which ceases to operate. Also, the disc 184 is moved to locate the curved section 224 into the dimple 196 and to move the shaft 76 whereby the piercing tip of the cutter 74 is moved to a position just inboard of the rim 77 of the can 82. Further, the actuator 86 is moved to the partially lowered position.

The user then raises the actuator 86 to the fully raised position, as illustrated in FIGS. 4 and 9, where the lid 80, which is magnetically held with the magnet 100, is removed from its position at the top of the can 82. As the actuator 86 is being raised to the fully raised position, the finger 234 will move into the position shown in phantom in FIG. 13 to facilitate the raising of the actuating member 172, the motion transfer member 166, the slide member 158 and the switch closer 156, all as shown in FIG. 9.

Now that the actuator 86 has been fully raised, the user can safely remove the severed lid 80 from the magnet 100. Also, with the actuator 86 fully raised to the level and extent noted above, the can 82 is fully visible, as described above, and can be readily removed from the can opener 30.

Many features are described above, as embodied in the can opener 30, which facilitate the efficient and easy opening of the lid 80 from the can 82. One of these features includes the locating of the pivot pins 128 and 130 in the rear of the housing 32 to allow the front portion of the actuator 86 to be raised considerably above the area for attaching the can 82 to the can opener 30. This feature facilitates a clear view, for the user, of the can loading and unloading area of the can opener 30. Another feature relates to the coupling of the motion transfer member 166 to the disc 184 whereby movement of the actuator 86 is coupled to the disc for selective locating of the detent arm 208 in response to selective positioning of the actuator 86, in direct relation to the positioning of the cutter 74. Still another feature relates to the operation of the motor 132 in response to selective positioning of the switch mechanism 136 by controlled movement of the actuator 86, all of which is accomplished in conjunction with the positioning of the cutter 74. A further feature involves the lift arm 232 and finger 234 which facilitates the positioning of the switching mechanism 136 in response to the raising of the actuator 86 in preparation for a can loading or can unloading procedure. Another feature relates to the removability of the magnet assembly 98 from its nest 296 on the underside of the actuator 86 for a variety of purposes, including the cleaning of the assembly.

In general, the above-identified embodiments are not to be construed as limiting the breadth of the present invention. Modifications, and other alternative constructions, will be apparent which are within the spirit and scope of the invention as defined in the appended claims.

What is claimed is:

1. A can opener, which comprises;

a housing having an exterior working area on a front wall thereof, on which a drive wheel and a cutter are mounted for cutting a lid of a can;

the housing formed with a top wall which extends from a juncture thereof with the front wall to a rear juncture with a rear wall of the housing;

an actuator, the manipulation of which facilitates piercing of the lid by the cutter;

the actuator being attached to the housing generally at the rear juncture for selective movement relative to the housing and away from the front wall of the housing thereby to reveal fully the drive wheel and the cutter for easy access during loading and unloading of cans with respect to the working area;

the actuator being formed in a prescribed configuration;

the top wall being formed with a recess having a shape complementary to the prescribed shape; and the actuator being mounted for movement into and out of the recess.

2. The can opener as set forth in claim 1, which further comprises:

the actuator being formed with a top wall; and the actuator being movable into the recess to the extent that the top wall of the actuator is flush with the top wall of the housing.

3. The can opener as set forth in claim 2, which further comprises:

the actuator being formed with a rear wall;

a notch formed in the rear wall of the housing in a top edge thereof; and the rear wall of the actuator being located in the notch of the rear wall of the housing when the top wall of the actuator is flush with the top wall of the housing.

4. The can opener a set forth in claim 1, which further comprises:

a pivot support formed on an undersurface of the top wall adjacent the rear juncture; and the actuator being formed with a pivoting structure which is attachable to the pivot support to facilitate pivotal movement of the actuator relative to the housing.

5. The can opener as set forth in claim 4, wherein the pivot support comprises:

a first side wall formed on the undersurface of the top wall of the housing having a slot which opens toward the rear wall of the housing; and a second side wall formed on the undersurface of the top wall of the housing spaced from the first side wall and having a slot which opens toward the rear wall of the housing.

6. The can opener as set forth in claim 5, wherein the pivoting structure of the actuator comprises:

the actuator being formed with spaced side walls which extend to a rear portion of the actuator; and each of the side walls of the actuator formed with a pivot pin which mounts into a respective one of the slots formed in the first and second side walls which are formed on the undersurface of the of the top wall of the housing.

7. The can opener as set forth in claim 1, which further comprises:

a nest formed in an undersurface of the actuator having a prescribed structure; and a magnetic lid-attaching assembly formed with structure complementary to the prescribed structure; and the magnetic lid-attaching assembly being removably mounted within the nest of the actuator.

8. A can opener, which comprises:

a housing;

a can-lid cutter mounted on a face of the housing for cutting the lid of a can;

an actuator mounted for movement relative to the housing for facilitating operation of the can-lid cutter;

a nest of a prescribed structure formed in an undersurface of the actuator;

a magnetic lid-attaching assembly removably mounted within the nest of the actuator; and said nest comprising a pair of spaced rails mounted on the undersurface of the actuator.

9. The can opener as set forth in claim 8, wherein the magnetic lid-attaching assembly comprises:

a shelf forming an extended portion of the assembly; and the shelf removably mounted on and between the spaced rails of the actuator.

10. The can opener as set forth in claim 8, which further comprises:

the nest formed with at least one ledge having a notch formed in an edge thereof;

the magnetic lid-attaching assembly including a shelf having a knob extending from a surface of the shelf; and the shelf being removably mountable on the at least one ledge with the knob locating within the notch to removably retain the magnetic lid-attaching assembly within the nest.

11. The can opener as set forth in claim 10, which further comprises:

the shelf being formed with a first edge and a second edge each having an end which joins with the end of the other edge at a juncture thereof;

the shelf being formed with a slot in the first edge spaced slightly from the second edge thereof to form a finger between the second edge and the slot; and the knob mounted on the finger.

12. The can opener as set forth in claim 8, which further comprises:

the nest is formed by a pair of spaced "L" shaped rails;

each rail formed with a mounting ledge which is located in a common plane with, and spaced from, the other rail; and a shelf formed on the magnetic lid-attaching assembly with a dimension sufficient for opposite edges of the shelf to rest on the spaced L-shaped.

13. The can opener as set forth in claim 12, which further comprises:

a notch formed in an edge of at least one of the rails at a prescribed location;

a knob mounted on a surface of the shelf near an edge thereof; and the knob located in the notch when the shelf is located on the rails to removably retain the magnetic lid-attaching assembly with the actuator.

* * * * *